US009486120B2

(12) United States Patent
Day

(10) Patent No.: US 9,486,120 B2
(45) Date of Patent: Nov. 8, 2016

(54) WEARER COMFORT BACKPACK VACUUM

(71) Applicant: Tacony Corporation, Fenton, MO (US)

(72) Inventor: Alan Steven Day, Burleson, TX (US)

( * ) Notice: Subject to any disclaimer, the term of this patent is extended or adjusted under 35 U.S.C. 154(b) by 640 days.

(21) Appl. No.: 13/944,299

(22) Filed: Jul. 17, 2013

(65) Prior Publication Data

US 2015/0020345 A1 Jan. 22, 2015

(51) Int. Cl.

| | |
|---|---|
| ***A47L 5/36*** | (2006.01) |
| ***A47L 5/24*** | (2006.01) |
| ***A47L 9/22*** | (2006.01) |
| ***A47L 9/28*** | (2006.01) |

(52) U.S. Cl.

CPC ..... *A47L 5/24* (2013.01); *A47L 5/365* (2013.01); *A47L 9/22* (2013.01); *A47L 9/2889* (2013.01)

(58) Field of Classification Search

CPC ..... A47L 5/36; A47L 5/362; A47L 5/365; A47L 9/12; A45F 3/14–3/15

USPC ..... 15/327.5

See application file for complete search history.

(56) References Cited

U.S. PATENT DOCUMENTS

| | | | | |
|---|---|---|---|---|
| 5,267,371 | A * | 12/1993 | Soler | A47L 5/36 15/327.5 |
| 5,558,697 | A * | 9/1996 | Dyson | A47L 9/1625 55/310 |
| 5,588,177 | A * | 12/1996 | Eriksen | A47L 5/36 15/327.5 |
| 6,305,048 | B1 | 10/2001 | Salisian | |
| 6,370,729 | B2 | 4/2002 | Miyamoto | |
| 6,526,624 | B2 | 3/2003 | Miyamoto | |
| 6,857,163 | B2 | 2/2005 | Iida et al. | |
| 7,287,300 | B2 | 10/2007 | Rupp et al. | |
| 7,300,484 | B2 | 11/2007 | Scully et al. | |
| 7,526,833 | B2 | 5/2009 | Cochran et al. | |
| 7,774,896 | B2 * | 8/2010 | Andresen | A01G 1/125 15/326 |
| 8,032,980 | B2 | 10/2011 | Basenberg, Jr. et al. | |
| 8,181,833 | B2 * | 5/2012 | Wangeby | A45F 3/14 224/262 |
| 2005/0086762 | A1 | 4/2005 | Paris | |
| 2006/0005346 | A1 | 1/2006 | Rupp et al. | |
| 2007/0174992 | A1 | 8/2007 | Murray et al. | |
| 2007/0294855 | A1 * | 12/2007 | Iida | A01G 1/125 15/327.5 |
| 2011/0214250 | A1 * | 9/2011 | McLeod | A47L 9/0072 15/383 |
| 2011/0289718 | A1 * | 12/2011 | Basenberg, Jr. | A45F 3/14 15/327.5 |
| 2012/0246809 | A1 * | 10/2012 | Elam | A42B 3/048 2/424 |
| 2012/0315128 | A1 * | 12/2012 | Bujold | A41D 13/0025 415/121.3 |
| 2013/0061419 | A1 * | 3/2013 | Patrono | A47L 9/0081 15/326 |

OTHER PUBLICATIONS

Tacony, Inc., POWR-FLITE, Backpack Vacuums catalog product pages, 2 pages www.Powr-Flite.com.

* cited by examiner

*Primary Examiner* — Joseph J Hail
*Assistant Examiner* — Henry Hong
(74) *Attorney, Agent, or Firm* — Whitaker Chalk Swindle & Schwartz PLLC; Charles Gunter

(57) ABSTRACT

A backpack vacuum has a body made up of an upper cannister and a lower motor compartment. The vacuum body is supported on a wearer's back by a harness. A vacuum motor draws air from an opening in the upper cannister through a primary air flow path out an exhaust outlet from the lower motor compartment. An adjustable air flow opening in the cannister sidewalls creates a secondary air flow path through the vacuum body which creates a cooling air region adjacent the wearer's back in use.

8 Claims, 3 Drawing Sheets

WEARER COMFORT BACKPACK VACUUM

BACKGROUND OF THE INVENTION

1. Field of the Invention

The present invention relates generally to a portable vacuum system and, more specifically, to a backpack mounted portable vacuum system.

2. Description of the Prior Art

Portable vacuum systems, including backpack mounted vacuum systems, are known in the prior art. For example, Tacony, Inc., the assignee of the present invention presently markets a line of backpack vacuums under the Powr-Flite® brand, i.e., the PF600BP and PF1000BP models.

Backpack mounted vacuum systems are also discussed in the patent art. For example, U.S. Pat. No. 5,267,371, to Soler et al., shows an early cyclonic back-pack vacuum cleaner featuring a wearer harness and associated upper and lower casing attached to the harness. A cyclonic cleaning assembly is contained within the upper casing.

U.S. Pat. No. 5,588,177, to Eriksen, shows another backpack vacuum cleaner having a housing with a compartment for a filter bag, a connection branch for a suction hose, a hip strap to be applied around the hips of the bearer and a pair of shoulder straps. The design is intended to only limit as little as possible the freedom of movement of the bearer with respect to the upper part of his body and arms when using the vacuum cleaner, and at the same time to provide a vacuum cleaner with a comparatively big filter bag. The hip strap is fastened to the lower part and the shoulder straps are mutually interconnected with an equalizing device for equalizing differences in tension between the two straps.

U.S. Pat. No. 7,287,300, to Rupp et al., shows another backpack mounted portable vacuum system having a motor portion and a filter portion. The motor portion is cylindrically shaped and has a first vertical axis. The filter portion is also cylindrically shaped and has a second vertical axis that is horizontally offset from the first vertical axis. The horizontal offset provides for a larger debris container and debris fluid path.

U.S. Patent Publication No. 2005/0086762, to Paris, shows a portable backpack vacuum cleaner, carried on the back of the operator, by the means of shoulder and belt straps. The vacuum hose through which dirt is collected is connected to the vacuum unit at the bottom of the unit, supposedly providing for superior motor performance.

U.S. Patent Publication No. 2007/0174992 to Murray et al., shows a light-weight, quiet vacuum cleaner assembly for a backpack vacuum cleaner which includes an air inlet for communicating with a vacuum cleaner hose and a filter; a vacuum motor for drawing air through the vacuum cleaner hose, air inlet, and filter; and a quiet exhaust assembly module in communication with the vacuum motor for expelling and quieting exhaust from the vacuum motor.

From the above discussion, it can be seen that the manufacturers of existing lines of backpack vacuums have attempted to introduce various comfort features for increasing the comfort of the wearer of the backpack vacuum unit. These efforts include such things as the harness arrangements, the alignment of the weight bearing components and the addition of noise reducing features, for example. However, one feature that has not, to Applicant's knowledge, been addressed in the prior art is that fact that backpack vacuum units tend to heat up the back region of the wearer in use. This is generally due to the heat which is generated by the vacuum motor in the backpack unit. While the various known harness designs may include features to space the backpack unit from the wearer's back, they have not previously incorporated air flow features intended to provide a cooling or "air conditioning" effect for the back of the wearer.

Thus, despite the improvements which have been made in the relevant arts, a need continues to exist for further improvements which would increase the comfort of the backpack style vacuum wearer in use.

SUMMARY OF THE INVENTION

A wearer comfort backpack vacuum is shown which features a vacuum body including an upper cannister portion and a depending lower motor compartment. The cannister portion has an initially open interior defined by surrounding sidewalls and a top opening. A cover is provided for closing off the top opening of the cannister portion of the body. A vacuum hose communicates with the cannister interior. A vacuum motor is located within the lower motor compartment and is arranged for pulling air and debris from the vacuum hose in a primary air flow path, through the interior of the cannister portion, in the direction of the motor compartment and out and exhaust outlet. At least one filter element is disposed within the initially open interior of the cannister portion of the body. A harness is provided on the vacuum body for supporting the vacuum body on a wearer's back.

In the improved version of the backpack vacuum of the invention, a special air flow opening is provided in the surrounding sidewalls of the upper cannister portion of the vacuum body above the motor compartment. This special air flow opening defines a secondary air flow path through the cannister interior and out the exhaust outlet that would not normally be present. Air drawn into the interior of the cannister portion of the vacuum body through the special air flow opening and exhausted along the secondary air flow path creates a cooling air movement adjacent the wearer's back when the vacuum body is supported on the wearer's back by the harness.

Preferably, the special air flow opening in the surrounding sidewalls of the upper cannister portion of the vacuum body is selectively openable and closeable by degrees in order to vary the amount of air drawn into the cannister interior through the secondary air flow path. This can be accomplished, for example, by covering the special air flow opening in the surrounding sidewalls of the upper cannister portion of the vacuum body with some sort of movable closure, valve, or air flow restrictor. In one version of the invention, the air flow restrictor is a moveable plate. The plate can be provided with an air opening therein which is alignable in a first open position with the opening in the surrounding sidewalls of the cannister to permit the flow of air through the secondary air flow path into the cannister interior and which is moveable to a secondary closed position which closes off the secondary air flow path. Preferably, the plate is also movable to one or more intermediate positions between the open and closed positions.

A secondary feature of the invention concerns the vacuum nozzle or other tool that is customarily attached to the outer most extent of the vacuum hose and which is used to contact the surface to be cleaned. Adjustment of the movable plate with respect to the special air flow opening in the surrounding sidewalls of the cannister can be used as a vacuum brake/suction relief to reduce the degree of suction exerted by the vacuum nozzle or other tool on the surface being cleaned, when desired.

Additional objects, features and advantages will be apparent from the written description which follows.

DETAILED DESCRIPTION OF THE INVENTION

The preferred version of the invention presented in the following written description and the various features and advantageous details thereof are explained more fully with reference to the non-limiting examples and as detailed in the description which follows. Descriptions of well-known components and processes and manufacturing techniques are omitted so as to not unnecessarily obscure the principle features of the invention as described herein. The examples used in the description which follows are intended merely to facilitate an understanding of ways in which the invention may be practiced and to further enable those skilled in the art to practice the invention. Accordingly, the examples should not be construed as limiting the scope of the claimed invention.

Figure 1:
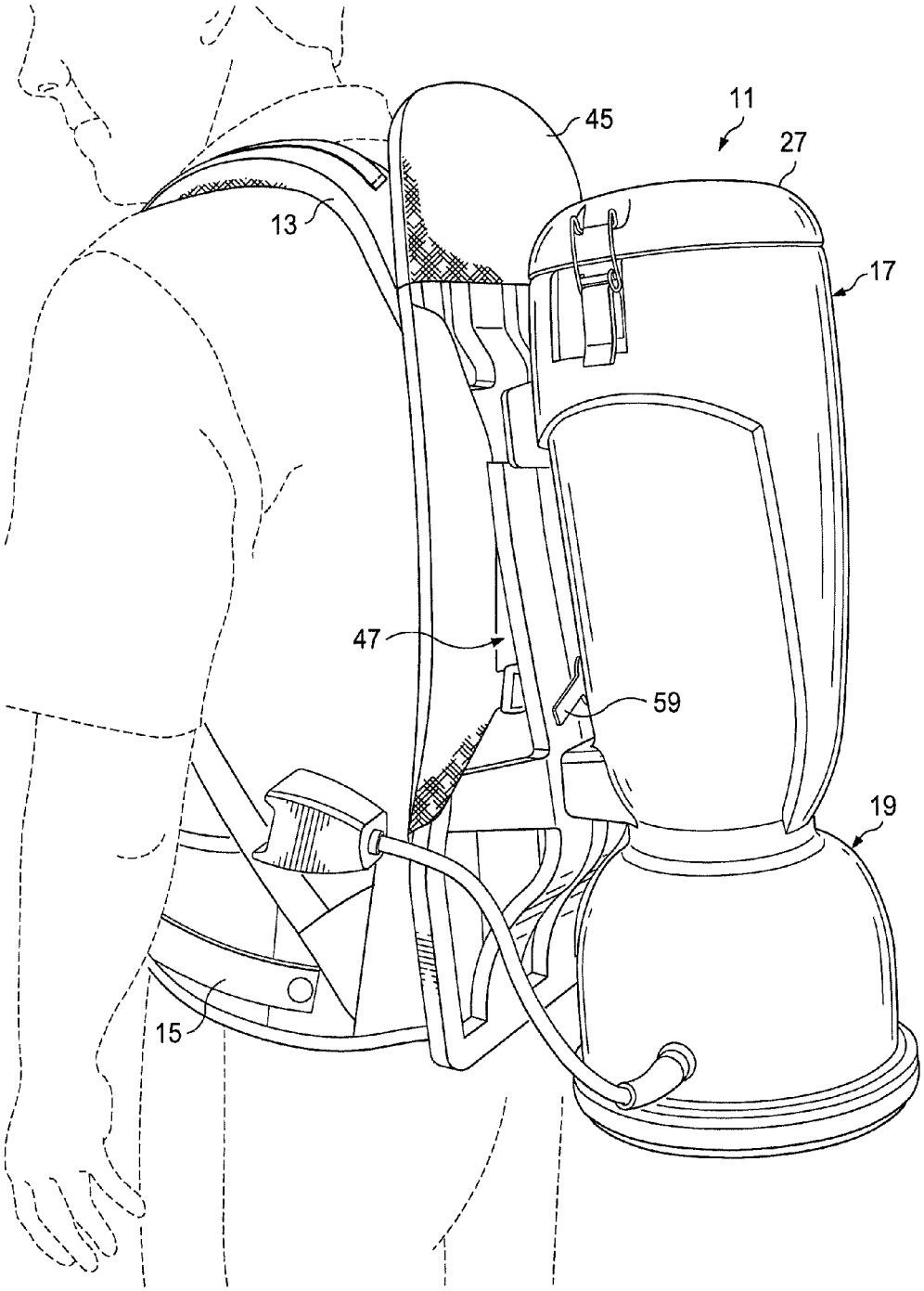
FIG. 1 is a perspective view of the wearer comfort backpack vacuum of the invention shown being supported on a wearer's back by an associated harness.

FIG. 1 is a perspective view of the wearer comfort backpack vacuum of the invention, designated generally as 11. The overall configuration of the backpack vacuum 11 is similar to that of several commercially available models sold by the assignee of the present invention as the Powr-Flite® PF600BP and the PF1000BP Backpack Vacuums, by Tacony, Inc. These units are available, for example, in either a 6 quart or 10 quart capacity. Both feature powerful suction to capture and contain soil, dust and other debris. The attachable vacuum hose and a variety of nozzle attachments make it easy to clean in confined and hard to reach locations. The units also feature an ergonomically designed, fully adjustable comfort-fit shoulder harness 13 and waist belt 15. The waist belt can so be used to carry additional tools, such as crevice, hard floor, easy glide carpet, upholstery, dusting tool and a 2 piece double-bend wand.

Figure 3:
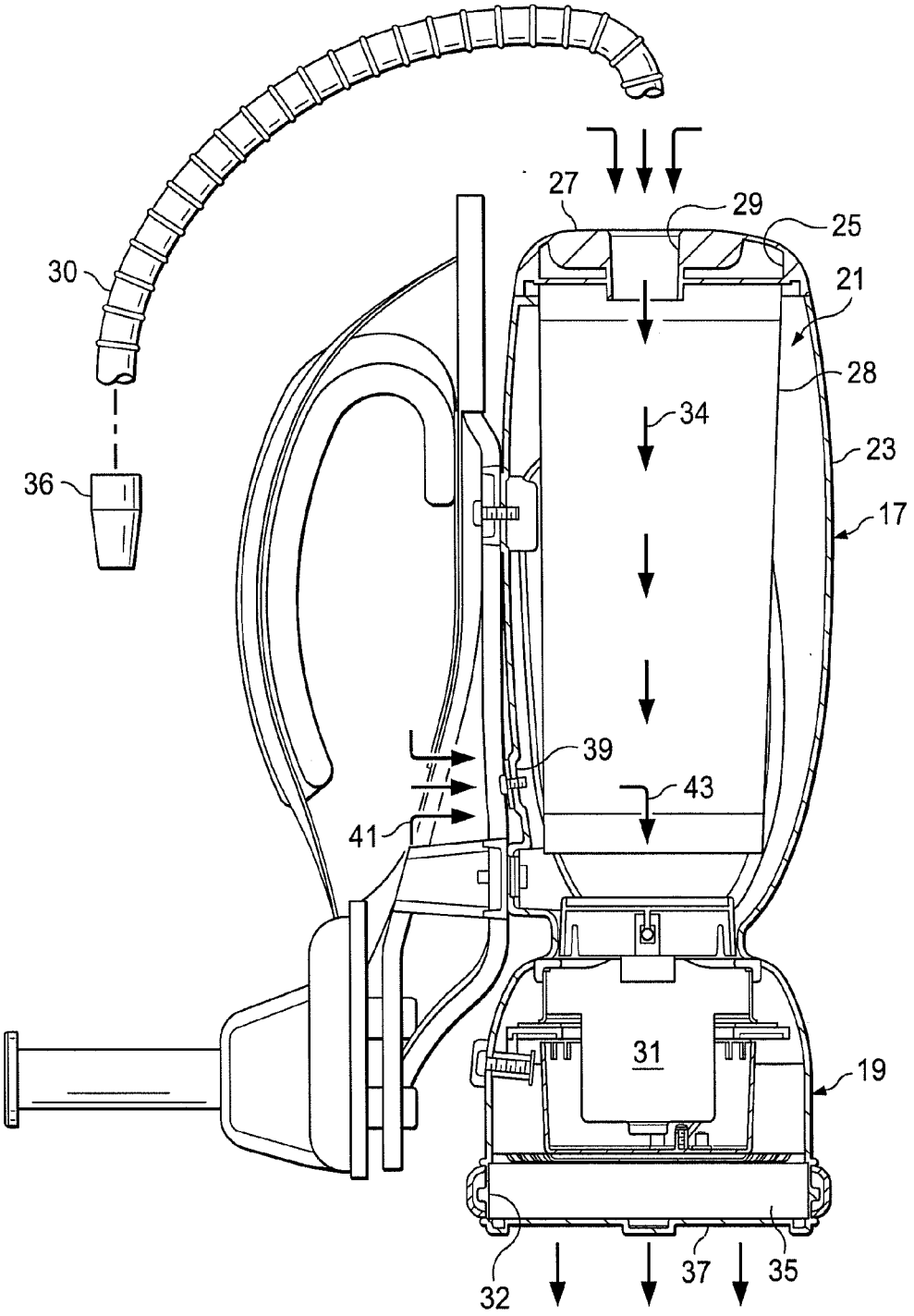
FIG. 3 is a simplified, partial cross-sectional view of the backpack vacuum of the invention showing the primary and secondary air flow paths though the interior of the vacuum cannister when the unit is in use.

As perhaps best seen in FIG. 3, the backpack vacuum 11 has a vacuum body including an upper cannister portion 17 and a depending lower motor compartment 19. The cannister portion has an initially open interior 21 defined by surrounding sidewalls 23 and a top opening 25. A hinged cover 27 provides access to the open interior 21 of the cannister portion of the vacuum body. In the version of the vacuum shown, the cover 27 also has an opening 29 for attachment of the vacuum hose 30 (shown in broken away fashion in FIG. 3). The vacuum hose 30 is of traditional design and terminates in a nozzle 36 or other tool attachment, as has been described. The opening 29 in the cover 27 thus provides air flow communication between the nozzle end of the vacuum hose and the cannister interior 21.

A vacuum motor 31 is located within the lower motor compartment 19 and is arranged for pulling air and debris from the vacuum hose in a primary air flow path through the interior 21 of the cannister portion, and out an exhaust outlet 32, In the exemplary version of the device shown in FIG. 3, the exhaust outlet is located on a bottom region of the lower motor compartment 19. However, it will be understood by those skilled in the relevant art, that the vacuum exhaust outlet could be in various locations depending upon the style of vacuum motor employed, including tangential and peripheral discharge vacuum motors. The particular vacuum motor 31 shown in FIG. 3 is of conventional design and is commercially available. It could be, for example, a 1.8 hp, 1-stage, 1400 watt vacuum motor. The vertically aligned black arrows 34 in FIG. 3 are intended to show the primary air flow path through the vacuum body.

At least one filter element will typically be disposed within the initially open interior 21 of the cannister portion of the body. For example, a cloth shake-out bag 28 is shown in FIG. 3 for ease of illustration. The shake-out bag 28 may also contain a paper disposable filter bag in nested fashion. In the version of the vacuum shown in FIG. 3, the exhaust outlet 32 on the bottom region of the lower motor compartment 19 also houses an exhaust filter element 35 which is held in place by the post filter frame 37.

Figure 2:
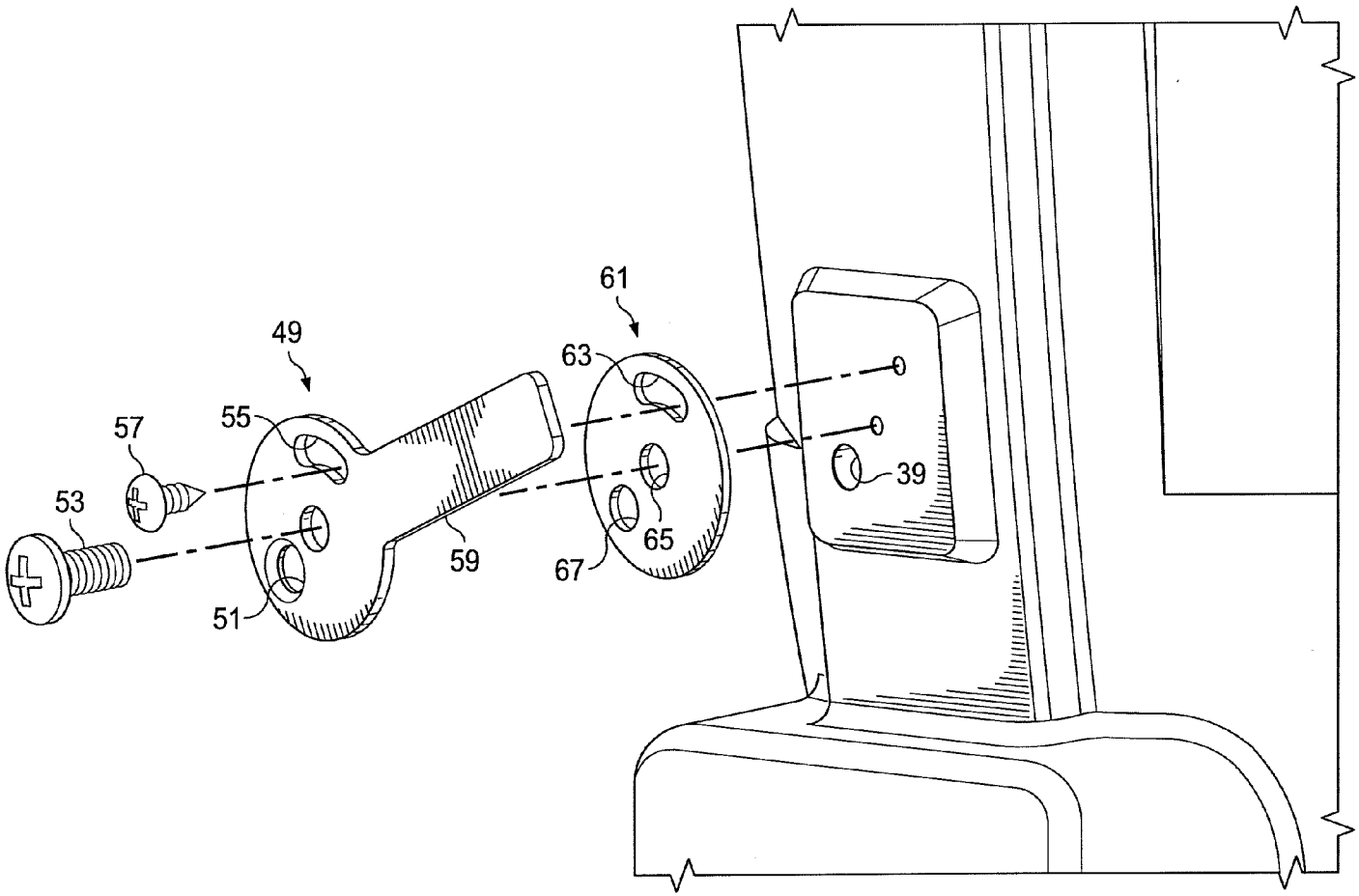
FIG. 2 is a close-up view of a portion of the rear cannister wall of the backpack vacuum of the invention showing the adjustable cover plate mechanism which is used to control the flow of outside air from the wearer's back region into the vacuum cannister, the cover plate mechanism being shown in exploded fashion for ease of illustration.

Now with respect to FIGS. 2 and 3, it will be appreciated that the backpack vacuum of the invention is provided with a special air flow opening 39 the surrounding sidewalls 23 of the upper cannister portion 17 of the vacuum body, above the motor compartment, which defines a secondary air flow path through the cannister interior 21. This secondary flow path is illustrated in FIG. 3 by means of the side arrows 41, 43. As shown by the side arrows 41, 43, when the vacuum motor 31 is in operation, air can be drawn into the interior 21 of the cannister portion of the vacuum body through the secondary air flow path. This flow of air creates a cooling air movement adjacent the wearer's back when the vacuum body is supported on the wearer's back by the harness straps 13.

It will be appreciated from FIG. 1 that the harness, in addition to shoulder straps 13 and waist belt 15 may be provided with a rigid frame portion 45. The rigid frame portion 45 will typically be formed of a suitable lightweight and durable plastic and will be ergonomically curved to fit the wearer's back and also create an air space (shown generally as 47 in FIG. 1) between the vacuum body and the wearer's back. Air drawn into the interior of the cannister portion of the vacuum body through the special air flow opening 39 and through the secondary air flow path creates a cooling air movement in the air space 47 which is created between the rigid frame portion 45 and between the vacuum body and the wearer's back when the vacuum body is supported on the wearer's back by the harness and its rigid frame portion.

It will be understood by those skilled in the art that the same principles of cooling which have been described with respect to backpack vacuum units having rigid harness components, such as the rigid frame shown in FIGS. 1 and 3 can also be applied to a backpack style vacuum without any style of rigid frame board or framework on the harness system. The particular system shown is intended to merely be illustrative of the intended working environment of the present invention.

As shown in FIGS. 2 and 3 of the drawings, the opening 39 in the sidewalls of the upper cannister portion 17 of the vacuum body is provided with some type of movable or adjustable closure mechanism to restrict the flow of air through the special air flow opening, when desired. The restrictor may be and on/off switch or mechanism, or may be selectively openable and closeable by degrees in order to vary the amount of air drawn into the cannister interior through the secondary air flow path. This can be accomplished in a number of ways. In one preferred version of the invention shown in FIGS. 2 and 3, the special air flow opening 39 has associated therewith a cover plate mechanism for controlling the flow of air through the opening 39. In the embodiment shown, the cover plate mechanism includes a movable cover plate element 49 which has an air opening 51 which is alignable in a first open position with the opening 39 in the surrounding sidewalls of the cannister to permit the flow of air through the secondary air flow path into the cannister interior and which is moveable to a secondary closed position which closes off the secondary air flow path.

In the version of the cover plate mechanism shown, the movable cover plate element 49 has a planar circular portion containing the air opening 51, a central opening for receiving an attachment bolt or screw 53 and a screw slot 55 for receiving the adjustment screw 57. The attachment bolt 53 allows rotational movement of the cover plate 49, the degree of rotation being limited by movement of the adjustment screw 57 in the slot 55. The movable cover plate element has an adjustment lever portion 59 extending outwardly therefrom which can conveniently be grasped by the user to vary the degree of opening of the special air flow opening 39 into the cannister interior (see FIG. 1). It should be apparent from the foregoing discussion that the lever 59 and associated hardware allows the cover plate mechanism to be moved, not only between the fully opened and closed positions, but also to one or more intermediate positions between the open and closed positions.

In the version of the cover plate mechanism illustrated in FIG. 2, the mechanism also includes a flexible gasket 61 which is located between the cover plate element 49 and the exterior of the vacuum body. The flexible gasket has mating holes 63, 65 and 67, which are alignable, respectively, with the adjustment screw, attachment bolt and air openings of the cover plate element. The flexible gasket 61 facilitates the easy adjustment of the cover plate element and also helps to reduce air leaks.

In addition to the feature of providing a cooling effect for the wearer's back, the secondary air flow path defined by the previously described components also provides an additional operational feature for the vacuum user. As has been described, the traditional vacuum hose used with the vacuum terminates outwardly in a vacuum nozzle or other tool which is used to contact a surface to be cleaned, dried, or the like. In some operating situations, it would actually be desirable to reduce the amount of suction being applied by the vacuum nozzle or other tool. This might be the case, for example, when cleaning delicate fabrics or surfaces. Fully opening the cover plate element air intake acts to slightly reduce the overall suction of the unit. Thus, adjustment of the movable cover plate with respect to the special air flow opening in the surrounding sidewalls of the cannister can be used as a vacuum brake/suction relief to reduce the degree of suction on the surface being cleaned when desired.

An invention has been provided with several advantages. The secondary air flow path which is created with the adjustable cover plate mechanism of the invention creates a cooling air space between the user's back and the backpack vacuum body, thereby "air conditioning" the user's back and adding to the comfort of the user. The improved backpack vacuum is simple in design and economical to manufacture and the improved cooling feature is easy to implement on existing commercially available backpack vacuum designs. As has been explained, the secondary air flow path also allows the user to adjust the degree of suction being applied to the surface being cleaned.

While the invention has been shown in only one of its forms, it is not thus limited but is susceptible to various changes and modifications without departing from the spirit thereof.

What is claimed is:

1. A wearer comfort backpack vacuum, comprising:

a vacuum body including a cannister portion and an adjacent motor compartment, the cannister portion having an initially open interior defined by surrounding sidewalls and an opening to the open interior;

a harness for supporting the vacuum body on a wearer's back;

a cover for the top opening of the cannister portion of the body;

a vacuum hose communicating with the cannister interior;

a vacuum motor located within the motor compartment arranged for pulling air and debris from a surrounding location, through the vacuum hose, in a primary air flow path through the interior of the cannister portion, and out an exhaust outlet to be exhausted back to the surrounding location;

at least one filter element disposed within the initially open interior of the cannister portion of the body;

a special air flow opening in the surrounding sidewalls of the cannister portion of the vacuum body which defines a secondary air flow path through the cannister interior secondary and in addition to the primary air flow path;

whereby air drawn into the interior of the cannister portion of the vacuum body through the secondary air flow path creates a cooling air movement adjacent the wearer's back by drawing atmospheric air from outside the cannister portion of the vacuum body into the interior of the cannister body when the vacuum body is supported on the wearer's back by the harness; and wherein the special air flow opening in the surrounding sidewalls of the cannister portion of the vacuum body has associated therewith an air flow restrictor element which is selectively openable and closeable to restrict the amount of atmospheric air drawn from outside the cannister portion of the vacuum body into the cannister interior through the secondary air flow path.

2. The wearer comfort backpack vacuum of claim 1, wherein the special air flow opening in the surrounding sidewalls of the cannister portion of the vacuum body is covered with a moveable plate, the plate having an air opening therein which is alignable in a first open position with the opening in the surrounding sidewalls of the cannister to permit the flow of air through the secondary air flow path into the cannister interior and which is moveable to a secondary closed position which closes off the secondary air flow path.

3. The wearer comfort backpack vacuum of claim 2, wherein the plate can be moved to one or more intermediate positions between the open and closed positions.

4. The wearer comfort backpack vacuum of claim 3, wherein the vacuum hose terminates outwardly in a vacuum nozzle which is used to contact a surface to be cleaned, and wherein adjustment of the plate with respect to the opening in the surrounding sidewalls of the cannister can be used as a vacuum brake/suction relief to reduce the degree of suction on the surface being cleaned when desired.

5. The wearer comfort backpack of claim 1, wherein the at least one filter element located in the cannister interior includes one or more removable filter media and wherein the exhaust outlet also has an exhaust filter element associated therewith, the secondary air flow path defined by the opening in the cannister sidewalls passing through the removable filter media and through the exhaust filter element before being exhausted through the exhaust outlet.

6. A wearer comfort backpack vacuum, comprising:

a vacuum body including an upper cannister portion and a depending lower motor compartment, the cannister portion having an initially open interior defined by surrounding sidewalls and a top opening;

a harness for supporting the vacuum body on a wearer's back;

a cover for the top opening of the cannister portion of the body;

a vacuum hose communicating with the cannister interior through an inlet opening provided in the cover;

an electric vacuum motor located within the lower motor compartment arranged for pulling air and debris from a surrounding location, through the inlet opening, through a generally vertical primary air flow path through the interior of the cannister portion, and out an exhaust outlet to be exhausted back to the surrounding location;

one or more removable filter media disposed within the initially open interior of the cannister portion of the body;

a special air flow opening in the surrounding sidewalls of the upper cannister portion of the vacuum body above the motor compartment which defines a secondary air flow path through the cannister interior secondary and in addition to the primary air flow path;

whereby air drawn into the interior of the cannister portion of the vacuum body through the secondary air flow path creates a cooling air movement in the air space between the vacuum body and the wearer's back by drawing atmospheric air from outside the cannister portion of the vacuum body into the interior of the cannister body when the vacuum body is supported on the wearer's back by the harness;

wherein the special air flow opening in the surrounding sidewalls of the upper cannister portion of the vacuum body is covered with a moveable plate, the plate having an air opening therein which is alignable in a first open position with the opening in the surrounding sidewalls of the cannister to permit the flow of air through the secondary air flow path into the cannister interior and which is moveable to a secondary closed position which closes off the secondary air flow path to restrict the amount of atmospheric air drawn into the cannister interior from the outside the cannister portion of the vacuum body into the cannister interior through the secondary air flow path; and wherein the plate can be moved to one or more intermediate positions between the open and closed positions.

7. The wearer comfort backpack vacuum of claim 6, wherein the plate is a circular member which is rotatable about a central axis by means of an outwardly extending lever, the plate being separated from the cannister sidewalls by a flexible gasket.

8. The wearer comfort backpack vacuum of claim 6, wherein the vacuum hose terminates outwardly in a vacuum nozzle which is used to contact a surface to be cleaned, and wherein adjustment of the plate with respect to the opening in the surrounding sidewalls of the cannister can be used as a vacuum brake/suction relief to reduce the degree of suction on the surface being cleaned when desired.

* * * * *